US006989051B2

(12) United States Patent
Parisi et al.

(10) Patent No.: US 6,989,051 B2
(45) Date of Patent: Jan. 24, 2006

(54) PORTABLE AIR FILTRATION SYSTEM

(75) Inventors: Mark Joseph Parisi, East Amherst, NY (US); Donald John Enzinna, Lockport, NY (US); Susan Claire Vasko, Lockport, NY (US); Ilya Reyzin, Williamsville, NY (US); Stephan Michael Vetter, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 148 days.

(21) Appl. No.: 10/647,748

(22) Filed: Aug. 25, 2003

(65) Prior Publication Data

US 2005/0045037 A1 Mar. 3, 2005

(51) Int. Cl.
*B03C 3/155* (2006.01)

(52) U.S. Cl. ..... 96/67; 96/69; 96/97

(58) Field of Classification Search ..... 96/67, 96/69, 77, 97, 98; 95/59, 79; 55/DIG. 39
See application file for complete search history.

(56) References Cited

U.S. PATENT DOCUMENTS

| | | | | |
|---|---|---|---|---|
| 3,191,362 A | | 6/1965 | Bourgeois | 96/67 |
| 4,244,710 A | | 1/1981 | Burger | 95/69 |
| 4,354,858 A | | 10/1982 | Kumar et al. | 95/78 |
| 4,357,151 A | | 11/1982 | Helfritch et al. | 95/68 |
| 4,749,390 A | * | 6/1988 | Burnett et al. | 96/57 |
| 4,768,423 A | | 9/1988 | Boeger | 454/146 |
| 4,940,470 A | | 7/1990 | Jaisinghani et al. | 95/78 |
| 5,133,788 A | | 7/1992 | Backus | 55/467 |
| 5,268,009 A | | 12/1993 | Thompson et al. | 96/67 |
| 5,403,383 A | | 4/1995 | Jaisinghani | 95/69 |
| 5,433,772 A | | 7/1995 | Sikora | 96/87 |
| 5,474,600 A | * | 12/1995 | Volodina et al. | 96/57 |
| 5,549,735 A | | 8/1996 | Coppom | 96/63 |
| 5,702,507 A | * | 12/1997 | Wang | 96/55 |
| 5,948,355 A | | 9/1999 | Fujishima et al. | 422/4 |
| 6,056,809 A | * | 5/2000 | Chapman | 96/67 |
| 6,355,095 B1 | * | 3/2002 | Kuo-Long | 96/26 |
| 6,391,093 B1 | | 5/2002 | French et al. | 95/226 |
| 6,491,743 B1 | * | 12/2002 | Joannou et al. | 96/67 |
| 6,497,754 B2 | * | 12/2002 | Joannou | 96/67 |
| 6,527,834 B1 | * | 3/2003 | Jorder et al. | 96/68 |
| 6,790,259 B2 | * | 9/2004 | Rittri et al. | 95/78 |

FOREIGN PATENT DOCUMENTS

| | | |
|---|---|---|
| GB | 1559629 | 1/1980 |
| JP | 62087262 | 4/1987 |
| WO | 9820979 | 5/1998 |

* cited by examiner

*Primary Examiner*—Richard L. Chiesa
(74) *Attorney, Agent, or Firm*—Patrick M. Griffin

(57) ABSTRACT

A portable air filtration system includes a filter housing having an air inlet and an air outlet. The filter housing defines a filtration chamber between the air inlet and the air outlet. The portable air filtration system uses an ionizing mechanism, a filter media, and an electrode to filter air. The ionizing mechanism ionizes particles within the air to a negative charge. The filter media is disposed between the ionizing mechanism and the air outlet for entrapping the particles. The electrode is disposed between the ionizing mechanism and the filter media to establish an electric field. The electric field is established between the ionizing mechanism and the electrode adjacent to the filter media. The electrode is also electrically-connected to ground and to the filter media for dissipating the negative charge of the particles entrapped within the filter media.

24 Claims, 3 Drawing Sheets

PORTABLE AIR FILTRATION SYSTEM

RELATED APPLICATIONS

This application is related to co-pending U.S. Pat. application Ser. No. 10/647,482 entitled "Portable Air Filtration System Utilizing A Conductive Coating And A Filter For Use Therein" which is commonly assigned and was filed on the same date as the present application. Each application is directed to a different invention.

TECHNICAL FIELD

The subject invention generally relates to a portable air filtration system for filtering air. The portable air filtration system of the subject invention is primarily for use in vehicles but may also be used to filter air in rooms of commercial and residential buildings.

BACKGROUND OF THE INVENTION

Air filtration systems are known in the art. Many of these air filtration systems utilize ionization to enhance efficiency of a filter used within the air filtration system. The air filtration systems of the prior art are deficient for a variety of reasons.

One example of a prior art air filtration system is disclosed in U.S. Pat. No. 4,940,470 to Jaisinghani et al. With particular reference to FIG. 1 of the '470 patent, this air filtration system is deficient because the electrode E, a ground electrode, is positioned downstream from the filter F. As such, the filter F is disposed within the electric field that is established between the ionizing wires W and the electrode E. Ultimately, this particular air filtration system presents a safety hazard as the filter F may be exposed to arcing that occurs in the electric field. The filter F may catch fire, destroy the air filtration system, and be dangerous to users of the air filtration system.

A further example of a prior art air filtration system is disclosed in U.S. Pat. No. 5,403,383 also to Jaisinghani et al. With particular reference to FIG. 1 of the '383 patent, this air filtration system is deficient for the same reason identified above with respect to the '470 patent. That is, the ground electrode 106 is positioned downstream from the filter 114 such that the filter 114 is disposed within the electric field that is established between the ionizing wires 110 and the ground electrode 106. This position of the ground electrode 106 presents the same safety issues described above, i.e., exposure of the filter 114 to arcing in the electric field. However, the air filtration system disclosed in the '383 patent is also deficient because it requires two electrodes that are separate from one another, a control electrode 104 and a downstream ground electrode 106, for sufficient ionization. The requirement for this additional componentry is unnecessary. Therefore, the design for this air filtration system is not optimized and is unnecessarily expensive.

Finally, many of the air filtration systems of the prior art are deficient in that they are not sufficiently portable. That is, many air filtration systems are heavy, bulky, and awkward. For example, many air filtration systems do not include a handle for conveniently carrying the air filtration system from vehicle to vehicle or from room to room. Other air filtration systems include a filter housing that is constructed of a metal which tends to add weight to the air filtration system and makes it heavy to carry.

Due to the various deficiencies associated with the air filtration systems of the prior art, including those described above, it is desirable to provide a novel air filtration system that is safe, portable, and has simplified componentry yet still achieves enhanced filtration of particles from air.

SUMMARY OF THE INVENTION

A portable air filtration system for filtering air is disclosed. The air filtration system includes a filter housing, an intake fan, an ionizing mechanism, a filter media, and an electrode. More specifically, the filter housing includes an air inlet and an air outlet and defines a filtration chamber between the air inlet and the air outlet. The intake fan is disposed within the filter housing to move the air through the filtration chamber by drawing the air in through the air inlet and dispelling the air out through the air outlet. The ionizing mechanism, which is disposed between the intake fan and the air outlet, ionizes particles within the air to a negative charge. The filter media is disposed between the ionizing mechanism and the air outlet for entrapping the particles.

The electrode is disposed between the ionizing mechanism and the filter media. As a result, an electric field is established between the ionizing mechanism and the electrode adjacent to the filter media. Therefore, the filter media is not within the electric field. In addition, the electrode is electrically-connected to ground and to the filter media. The negative charge of the particles that are entrapped within the filter media is dissipated through the electrode.

Accordingly, the subject invention provides a novel air filtration system that is safe. More specifically, because the filter media is not within the electric field, the filter media is not exposed to any arcing within the electric field and is not susceptible to catching fire. Furthermore, the air filtration system of the subject invention eliminates the need for a separate control electrode and ground electrode. Instead, this air filtration system simplifies the required componentry by integrating the control electrode and the ground electrode into a single electrode. This single electrode provides a plane for establishing the electric field with the ionizing mechanism and also provides a ground for dissipating charges in the filter media. It is also advantageous that the air filtration system of the subject invention is portable.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Referring to the Figures, wherein like numerals indicate like or corresponding parts throughout the several views, a portable air filtration system is generally disclosed at 10. For descriptive purposes only, the portable air filtration system 10 of the subject invention is hereinafter referred to as the filtration system 10.

Preferably, the filtration system 10 is used to filter air in a vehicle. In such an embodiment, the filtration system 10 can be placed on a floor, on a seat, or on any other suitable surface within the vehicle. As such, the filtration system 10 can be adapted to be secured on the surface by a standard safety restraint system, i.e., a seatbelt. However, the filtration system 10 of the subject invention may also be used to filter air in rooms of commercial and residential buildings.

Although not required, it is most preferred that the filtration system 10 include a handle 12 that is integrated into the filter housing 14. The handle 12 enhances the portability of the filtration system 10. As such, the filtration system 10 is mobile and can be conveniently moved from vehicle to vehicle or from room to room. As disclosed in FIG. 3, the handle 12 can be integrated into a filter housing 14 simply by being a recess within the filter housing 14 that can be accessed by a hand. Alternatively, although not disclosed in the Figures, the handle 12 can be integrated into the filter housing 14 by extending, either in a fixed manner or in a pivotable manner, from the filter housing 14.

Figure 3:
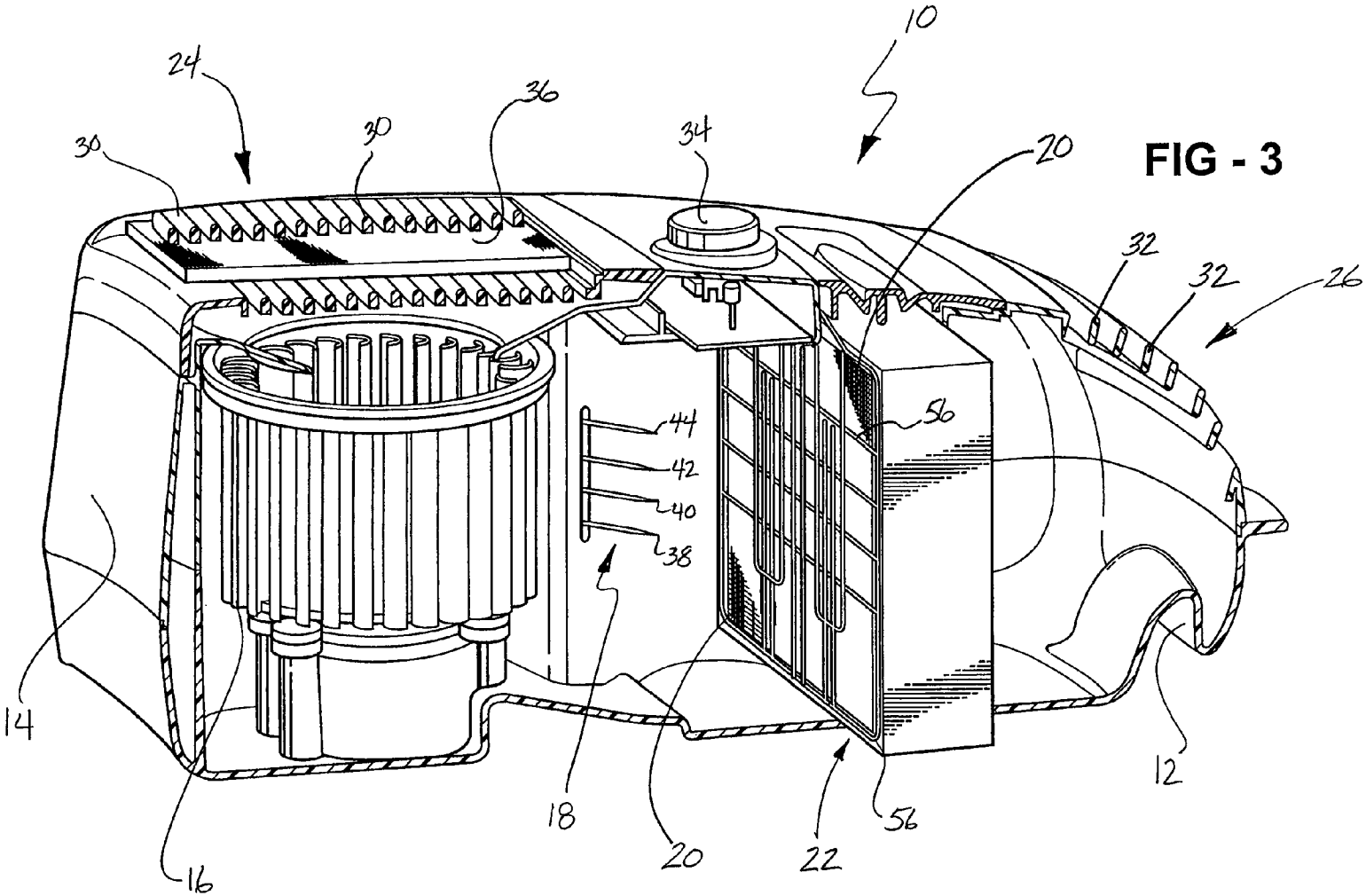
FIG. 3 is a partially cross-sectional perspective view of the portable air filtration system.
Figure 4:
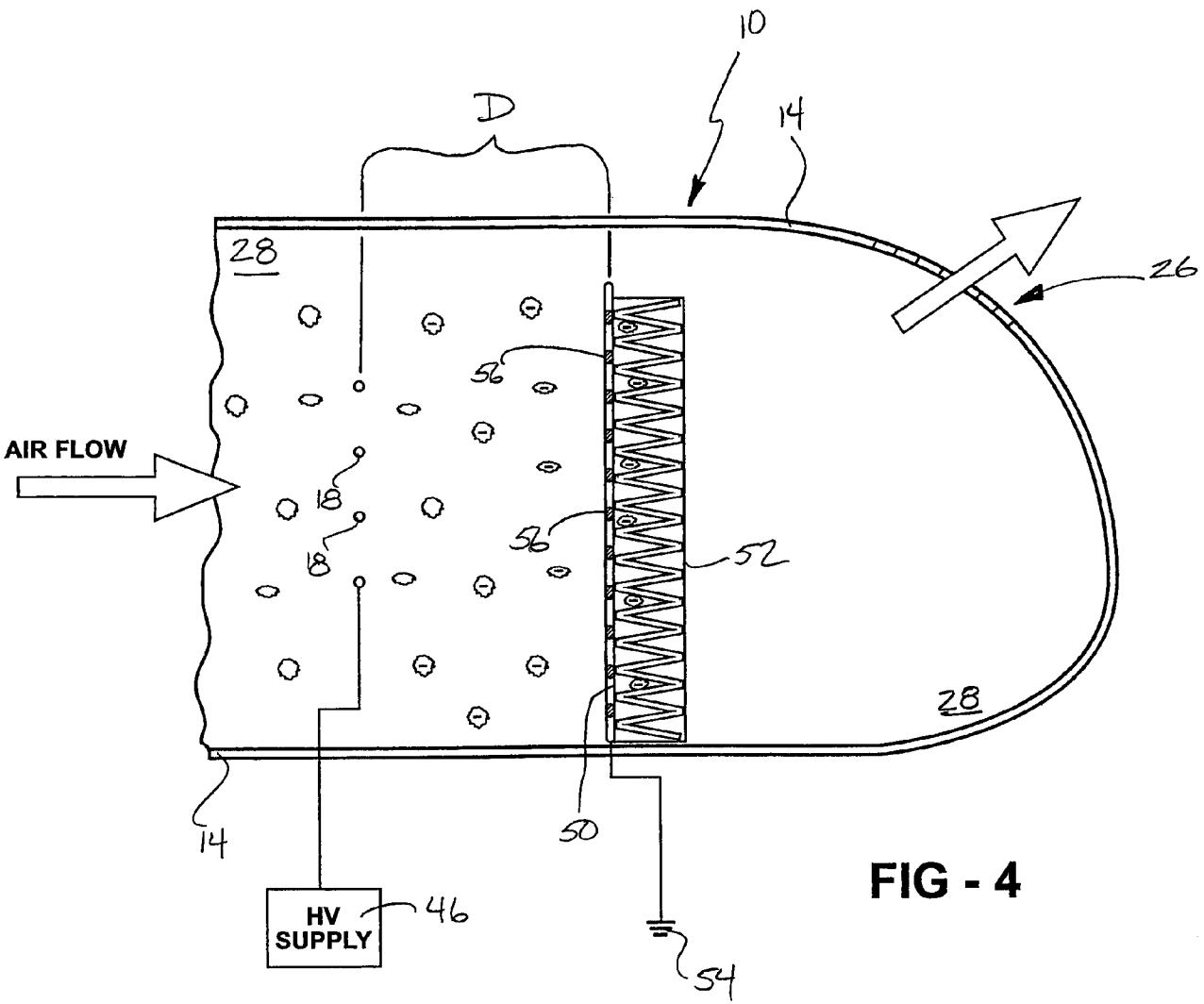
FIG. 4 is a schematic representation of the portable air filtration system illustrating flow of air across an ionizing mechanism, an electric field, an electrode, and a filter media.

Referring particularly to FIGS. 3 and 4, the filtration system 10 includes a filter housing 14, an intake fan 16, an ionizing mechanism 18, a filter media 20, and an electrode 22. Each of these components are described additionally below.

The filter housing 14 includes an air inlet 24 and an air outlet 26. The filter housing 14 also defines a filtration chamber 28 between the air inlet 24 and the air outlet 26. As schematically represented in FIG. 4, the air flows through the filtration chamber 28 where particles which are typically present in the air, such as dust, lint, pollen, allergens, and the like, are filtered. It is preferred that the filter housing 14 is plastic. That is, it is preferred that the filter housing 14 is made from a non-metal material that is either a thermoplastic or thermosetting polymeric material. To further enhance the transportability of the filtration system 10, the filtration system 10 is compact with the filter housing 14 having approximate dimensions of 390×190×170 mm. These dimensions can vary. However, the filtration system 10 of the subject invention provides a high level of clear air delivery rate (CADR) for such a compact unit.

Figure 1:
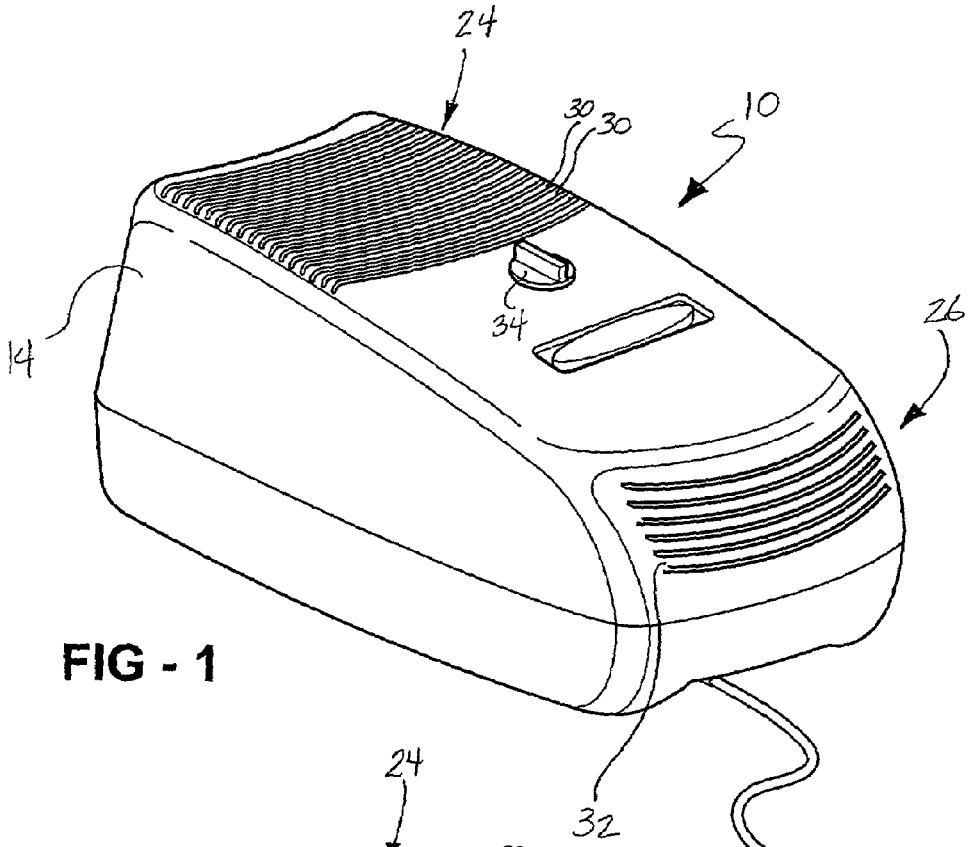
FIG. 1 is a perspective view of a portable air filtration system of the subject invention.

Referring to one preferred embodiment disclosed in FIG. 1, the air inlet 24 is further defined as inlet louvers 30 and the air outlet 26 is further defined as outlet louvers 32. Both the inlet louvers 30 and the outlet louvers 32 are defined within the filter housing 14.

Figure 2:
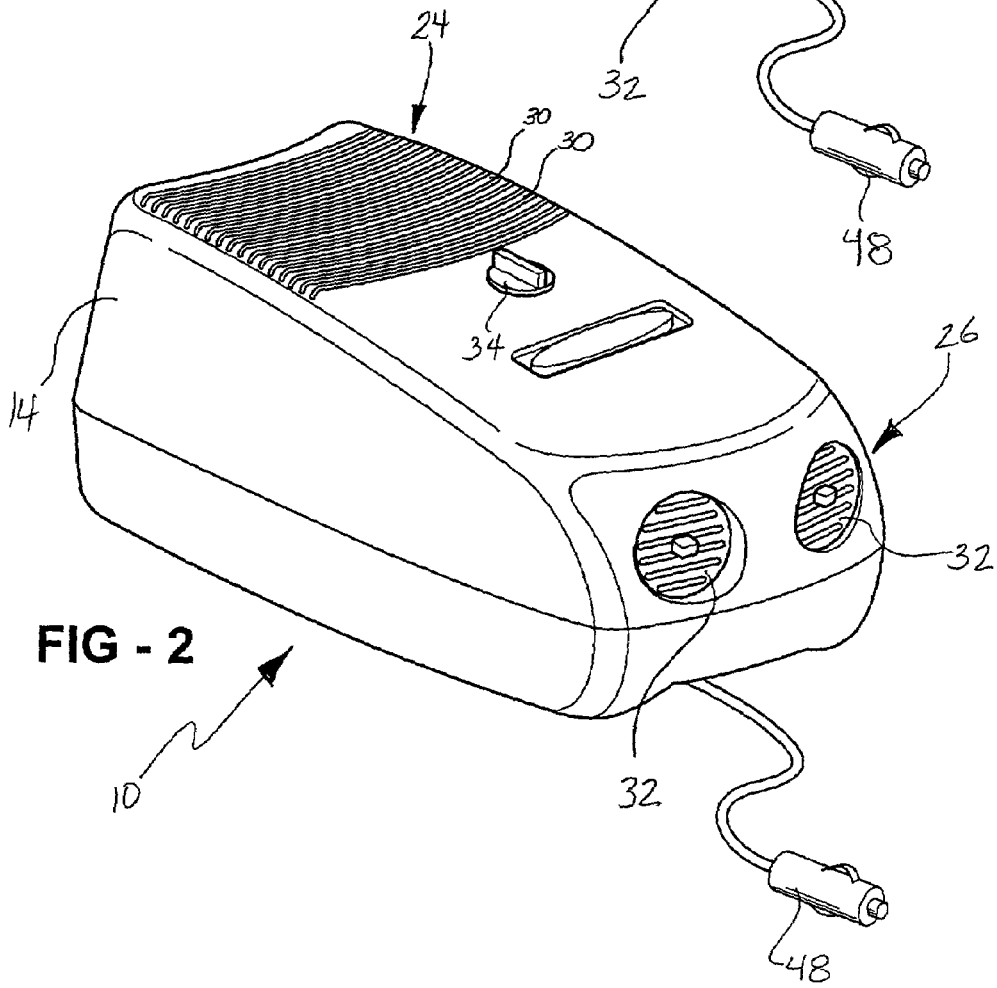
FIG. 2 is a perspective view of an alternative embodiment of the portable air filtration system illustrating adjustable louvers as an air outlet.

Referring to the most preferred embodiment of the subject invention, as disclosed in FIG. 2, at least one of the inlet louvers 30 and the outlet louvers 32 are adjustable. With the filtration system 10 disclosed in FIG. 2, only the outlet louvers 32 are adjustable. Although it is not disclosed in the Figures, it is possible for the inlet louvers 30 to be adjustable also.

The controllability, i.e., the ability to manipulate an angle, of the outlet louvers 32, is important so air exhausted out from the filtration system 10 can be targeted at a level where most occupants of a vehicle inhale and exhale. It is estimated that this level is achieved by angling the outlet louvers 32 approximately 60° upward, assuming the filtration system 10 is positioned on the seat of the vehicle. The range of angle for the outlet louvers 32 is typically 60° to 90°.

Referring to FIG. 3, the intake fan 16 is disposed within the filter housing 14. The intake fan 16 moves the air through the filtration chamber 28 by drawing the air in through the air inlet 24 and dispelling the air out through the air outlet 26. Preferably, the intake fan 16 is a centrifugal fan. It is also preferred that a speed of the intake fan 16 can be controlled such that users of the filtration system 10 can select a desired amount of filtering with a desired amount of noise level. As such, it is preferred that the filtration system 10 include an adjustment knob 34 that can be adjusted from low to high to control the speed of the intake fan 16. Clearly, increasing the speed of the intake fan 16 draws more air in through the air inlet 24 to be filtered but produces more noise, and vice versa.

Furthermore, although it is not required, the filtration system 10 preferably incorporates a pre-filter 36 between the air inlet 24 and the intake fan 16. The pre-filter 36, typically an activated carbon pre-filter, is primarily used to absorb odors present in the air as the air is drawn in through the air inlet 24.

The ionizing mechanism 18 is disposed between the intake fan 16 and the air outlet 26. In this position, the ionizing mechanism 18 ionizes the particles within the air to a negative charge, i.e. a negative state. Preferably, the ionizing mechanism 18 is further defined as a plurality of ionizing needles. More specifically, in the most preferred embodiment of the subject invention as disclosed in FIG. 3, the plurality of ionizing needles is further defined as a first 38, second 40, third 42, and fourth 44 ionizing needle. Any suitable number of ionizing needles can be utilized without varying the scope of the subject invention.

The filtration system 10 includes a high voltage power supply 46. The high voltage power supply 46 of the filtration system 10 is electrically-connected to the ionizing mechanism 18 and is electrically-connected to an energy source of the vehicle. For example, as disclosed in FIGS. 1 and 2, the filtration system 10 includes an adapter 48. The adapter 48 extends from the high voltage power supply 46. This adapter 48 is designed to insert into a cigarette lighter, or other port, in the vehicle and to tap into the energy source, such as a 12V battery, of the vehicle. It is preferred that the filtration system 10 also includes a circuit that incorporates a unique shut-off feature to protect a charge of the battery of the vehicle. There is also a DC—DC power converter incorporated into the circuit for supplying power to the filtration system 10. If the filtration system 10 of the subject invention is to be used in the rooms of commercial and residential buildings, then the high voltage power supply 46 of the filtration system 10 is operatively connected to an electrical system of the building, and a different adapter is utilized to plug into an electrical outlet.

To effectively ionize the particles within the air, the high voltage power supply 46 supplies a high voltage, approximately −15 kV, to the ionizing mechanism 18. However, this high voltage is at a very low amperage, less than 1 milliamp, such that less than 10 W of power is required overall.

The filter media 20 is disposed between the ionizing mechanism 18 and the air outlet 26. Ultimately, the filter media 20 entraps the particles yet allows the air to pass through the filtration system 10. As described additionally below, the filter media 20 is an electrically-enhanced filter (EEF) media and preferably can be removed from the filter housing 14 for replacement purposes over time. With particular reference to the Figures, the filter media 20 includes an upstream side 50 and a downstream side 52. The upstream side 50 faces the air inlet 24 and the downstream side 52 faces the air outlet 26. Several different filter media 20 are suitable for use in the filtration system 10 of the subject invention including, but not limited to, woven filter media, non-woven filter media, and cellular filter media.

The electrode 22 is disposed between the ionizing mechanism 18 and the. filter media 20 to establish an electric field between the ionizing mechanism 18 and the electrode 22. The electric field that is established is adjacent to the filter media 20. That is, the filter media 20 is not actually within the electric field. As such, the particles within the air are ionized upstream of the filter media 20 and no fire and/or other safety hazard is present with the filtration system 10 of the subject invention.

The electric field has a distance D, defined between the ionizing mechanism 18 and the electrode 22, that has been optimized to control an ionization current applied to the particles and to prevent ozone generation, which is an additional deficiency associated with the air filtration systems of the prior art. The distance D has been optimized to range from 35 to 60, preferably from 40 to 50, mm.

As disclosed schematically in FIG. 4, the electrode 22 is electrically-connected to ground 54. The electrode 22 is also electrically-connected to the filter media 20 for dissipating, i.e., bleeding, the negative charge of the particles that become entrapped within the filter media 20. More specifically, the electrode 22 is electrically-connected to the upstream side 50 of the filter media 20. Therefore, the negative charge of the particles entrapped with the filter media 20 is dissipated through the upstream side 50. For the negative charge of the particles entrapped within the filter media 20 to dissipate to ground 54 through the electrode 22, it is important that the filter media 20 be slightly conductive. That is, although the filter media 20 is 'relatively' dielectric and is, therefore, a poor conductor as compared to the conductivity of the electrode 22, the filter media 20 still must possess some degree of conductivity for the charge to dissipate to ground 54 through the electrode 22.

As described above, the electrode 22 is electrically-connected to the filter media 20. To establish this electrical connection, it is preferred that the electrode 22 is in direct contact with the filter media 20. However, it is to be understood that the electrode 22 is not required to be in direct contact with the filter media 20 for the electrical connection to be present. Instead, the electrode 22 may be spaced from the filter media 20 and may be indirectly electrically-connected to the filter media 20 in any other suitable manner such as, for example, relying on additional componentry.

With the electrode 22 in this position, i.e., upstream of the filter media 20, and with the electrode 22 electrically-connected to both ground 54 and the filter media 20, the electrode 22 is able to perform two functions. First, the electrode 22 of the subject invention provides a plane for establishing the electric field with the ionizing mechanism 18, which is normally the function of a discrete control electrode that is separate from a ground electrode. Secondly, the electrode 22 of the subject invention provides a ground 54 for dissipating charges present in the filter media 20, which is normally the function of a discrete ground electrode that is separate from a control electrode. Because the electrode 22 of the subject invention integrates the function of the two separate electrodes present in the prior art, the filtration system 10 of the subject invention has simplified componentry.

Referring particularly to FIGS. 3 and 4, the electrode 22 is further defined as a conductive grid 56. The conductive grid 56, functioning as the electrode 22, is electrically-connected to the upstream side 50 of the filter media 20. The conductive grid 56 can be metallic, i.e., a conductive metal, or conductive plastic. The most preferred conductive grid 56 is aluminum. The conductive grid 56 is adhesively bonded to the filter media 20. For example, a chemical adhesive that is conductive can be used to adhere and therefore electrically-connect the conductive grid 56 to the filter media 20. The electrode 22, and more specifically the conductive grid 56, can be electrically-connected to the filter media 20 in any other suitable manner including, but not limited to, using electrically conductive connectors and fasteners between the electrode 22 and the filter media 20. In an alternative embodiment of the subject invention, the electrode 22 is further defined as a conductive coating that is applied to the filter media 20. In this embodiment, the conductive coating is more specifically applied to the upstream side 50 of the filter media 20.

The invention has been described in an illustrative manner, and it is to be understood that the terminology that has been used is intended to be in the nature of words of description rather than of limitation. Obviously, many modifications and variations of the present invention are possible in light of the above teachings. Therefore, it is to be understood that within the scope of the appended claims, the invention may be practiced otherwise than as specifically described.

What is claimed is:

1. A portable air filtration system for filtering air, said filtration system comprising:

a filter housing including an air inlet and an air outlet and defining a filtration chamber between said air inlet and said air outlet;

an intake fan disposed within said filter housing for moving the air trough said filtration chamber by drawing the air in through said air inlet and dispelling the air out through said air outlet;

an ionizing mechanism disposed between said intake fan and said air outlet for ionizing particles within the air to a negative charge;

a filter media disposed between said ionizing mechanism and said air outlet for entrapping the particles; and an electrode disposed between said ionizing mechanism and said filter media to establish an electric field between said ionizing mechanism and said electrode adjacent to said filter media, wherein said electrode is electrically-connected to ground and to said filter media for dissipating the negative charge of the particles entrapped within said filter media.

2. An air filtration system as set forth in claim 1 wherein said electrode is spaced from said ionizing mechanism such that said electric field has a distance defined between said electrode and said ionizing mechanism that ranges from 35 to 60 mm.

3. An air filtration system as set forth in claim 2 wherein said distance ranges from 40 to 50 mm.

4. An air filtration system as set forth in claim 1 wherein said filter media comprises an upstream side facing said air inlet and a downstream side facing said air outlet with said electrode being electrically-connected to said upstream side of said filter media for dissipating the negative charge of the particles entrapped with said filter media through said upstream side.

5. An air filtration system as set forth in claim 1 further comprising a pre-filter disposed between said air inlet and said intake fan.

6. An air filtration system as set forth in claim 1 wherein said filter housing is plastic.

7. An air filtration system as set forth in claim 1 wherein said filter media is removable from said filter housing.

8. An air filtration system as set forth in claim 1 wherein said air inlet is further defined as inlet louvers defined within said filter housing.

9. An air filtration system as set forth in claim 1 wherein said air outlet is further defined as outlet louvers defined within said filter housing.

10. An air filtration system as set forth in claim 8 wherein said air outlet is further defined as outlet louvers defined within said filter housing.

11. An air filtration system as set forth in claim 10 wherein at least one of said inlet louvers and said outlet louvers are adjustable.

12. An air filtration system as set forth in claim 1 wherein said filter media is further defined as a woven filter media.

13. An air filtration system as set forth in claim 1 wherein said filter media is further defined as a non-woven filter media.

14. An air filtration system as set forth in claim 1 wherein said filter media is further defined as a cellular filter media.

15. An air filtration system as set forth in claim 1 wherein said electrode is further defined as a conductive grid.

16. An air filtration system as set forth in claim 15 wherein said conductive grid is adhesively bonded to said filter media.

17. An air filtration system as set forth in claim 15 wherein said conductive grid is plastic.

18. An air filtration system as set forth in claim 15 wherein said conductive grid is metallic.

19. An air filtration system as set forth in claim 18 wherein said conductive grid is aluminum.

20. An air filtration system as set forth in claim 4 wherein said electrode is further defined as a conductive grid electrically-connected to said upstream side of said filter media.

21. An air filtration, system as set forth in claim 1 wherein said ionizing mechanism is further defined as a plurality of ionizing needles.

22. An air filtration system as set forth in claim 21 wherein said plurality of ionizing needles is further defined as a first, second, third, and fourth ionizing needle.

23. An air filtration system as set forth in claim 1 further comprising a power supply electrically-connected to said ionizing mechanism.

24. An air filtration system as set forth in claim 1 further comprising a handle integrated into said filter housing to enhance portability of said air filtration system.

* * * * *